United States Patent [19]

Schneerson et al.

[11] 4,229,957

[45] Oct. 28, 1980

[54] LOCKING MECHANISM AND LOCKS INCORPORATING SAID MECHANISM

[76] Inventors: Moshe Schneerson, 189a Assirey Zion Str., Kiriyat Sharet, Raanana; Anatoli Kofman, 8 Tamar St., Neve Monoson, both of Israel

[21] Appl. No.: 840,800

[22] Filed: Oct. 11, 1977

[30] Foreign Application Priority Data

| | | | |
|---|---|---|---|
| Oct. 11, 1976 | [IL] | Israel | 50660 |
| Aug. 29, 1977 | [IL] | Israel | 52849 |
| Sep. 12, 1977 | [IL] | Israel | 52931 |

[51] Int. Cl.[2] ..... E05B 29/08; E05B 65/06

[52] U.S. Cl. ..... 70/134; 70/364 R; 70/377; 70/407; 70/409

[58] Field of Search ..... E05B/19/06; 70/134, 70/364 R, 377, 409, 393, 402, 405, 407, 52, 38 R, 38 C, 38 A, 38 B

[56] References Cited

U.S. PATENT DOCUMENTS

| | | | |
|---|---|---|---|
| 2,301,155 | 11/1942 | Sebestien | 70/409 |
| 2,471,291 | 5/1949 | Soref | 70/52 |

*Primary Examiner*—Robert L. Wolfe

*Attorney, Agent, or Firm*—Charles W. Helzer

[57] ABSTRACT

A locking mechanism having at least one but preferably two locking bolts movably supported for guided linear movement in a housing between locked and unlocked positions. Where two locking bolts are employed, each locking bolt moves in a direction opposite from the other. The locking mechanism is characterized in that each locking bolt is comprised by at least two superposed bolt parts which are linearly movable along the longitudinal axis of the bolt relative to each other and are provided on the corresponding longitudinal edges with a plurality of spaced matching teeth having an angle of 10°–80°. A key is provided for guided linear movement through a keyhole perpendicular to the bolt parts and having teeth matching those in the bolt parts formed in at least one of its side edges and where two oppositely moving bolts are provided, the key has matching teeth formed in each of the side edges thereof. The movement of the bolt parts is effected by matching of their teeth with the teeth in the key in a manner such that one of the bolt parts moves linearly with continued insertion of the key until its teeth become aligned with the teeth in the other bolt part at which point both bolt parts move together as a single locking bolt between locking and unlocking positions.

22 Claims, 24 Drawing Figures

LOCKING MECHANISM AND LOCKS INCORPORATING SAID MECHANISM

The present invention concerns a new locking mechanism and locks incorporating said locking mechanism.

It is the object of the present invention to provide a locking mechanism which is of simple construction and is burglar proof, and in which the possibilities of combinations with keys for operating it are substantially unlimited.

It is a further object of the present invention to provide a latch bolt lock with the said locking mechanism.

It is a further object of the present invention to provide a padlock with the locking mechanism according to the invention and to further provide a special construction of said padlock.

It is still a further object of the present invention to incorporate said locking mechanism in a cylindrical member and to permit or prevent the rotation thereof.

A still further object of the invention is to utilize said mechanism in said cylinder to actuate a further mechanism, such as, for example, locking bars of the kind extending into different parts of a door frame.

The invention consists in a locking mechanism comprising a bolt adapted for guided linear movement in a housing, characterized in that the bolt is provided on ome longitudinal edge with a plurality of spaced teeth at an angle of 10°-80°, a key adapted for guided linear movement through a key-hole perpendicular to said bolt and having matching teeth in its side edge at a matching angle, the movement of the bolt being effected by the meshing of the teeth of the bolt with those of the key.

The invention is illustrated by way of example only in the accompanying drawings in which.

Figure 6A:
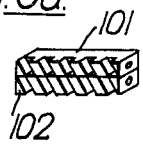
Figure 6B:
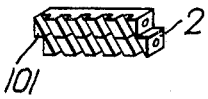

FIGS. 6*a* and 6*b* show a second embodiment of the locking mechanism according to the invention in an axonometric view in the unlocking and locking positions, respectively.

Figure 7:
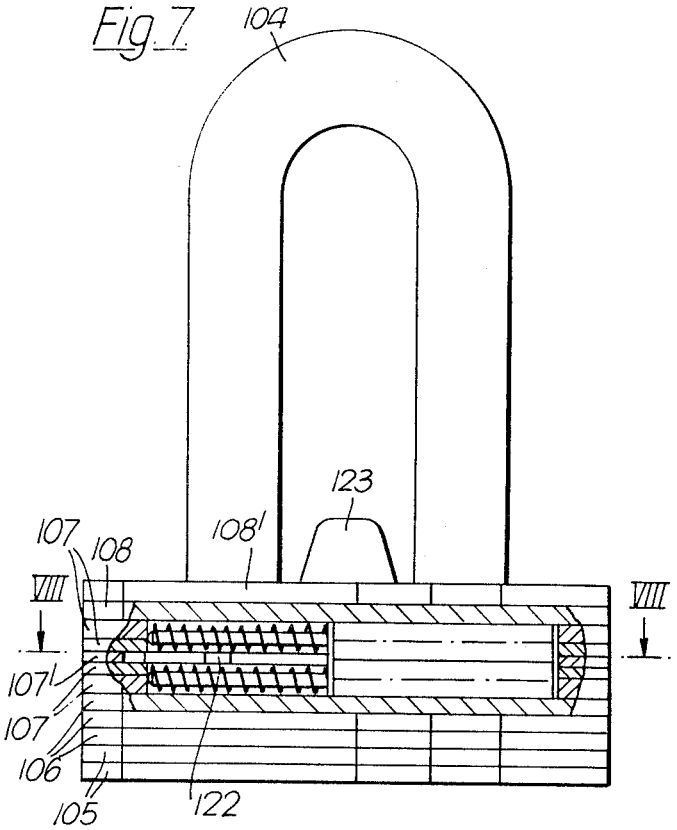

FIG. 7 shows an elevation of a padlock incorporating the mechanism according to the invention, which is shown in section.

Figure 8:
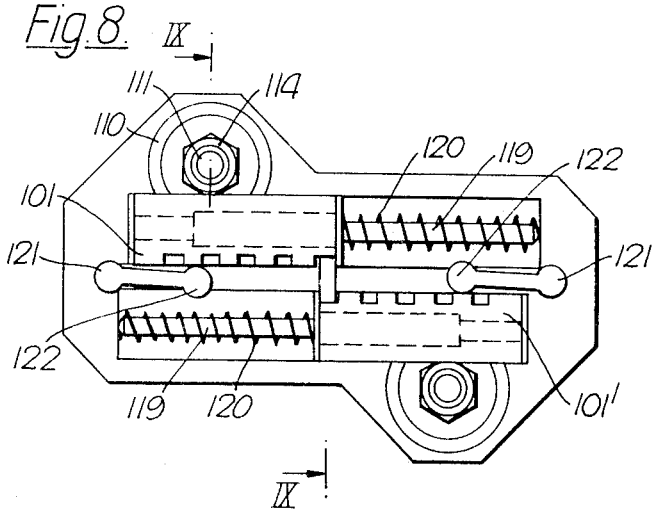

FIG. 8 is a section thereof on line VIII—VIII of FIG. 7.

Figure 9:
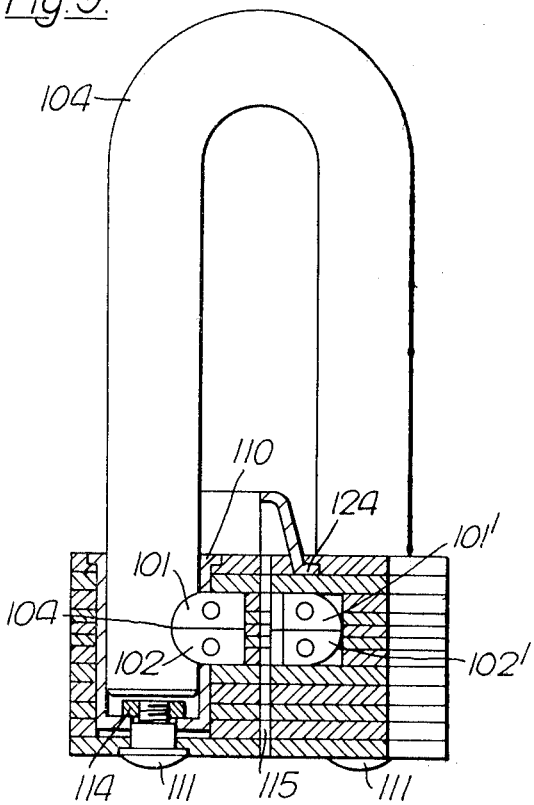

FIG. 9 is a section on line IX—IX of FIG. 8.

Figure 10:
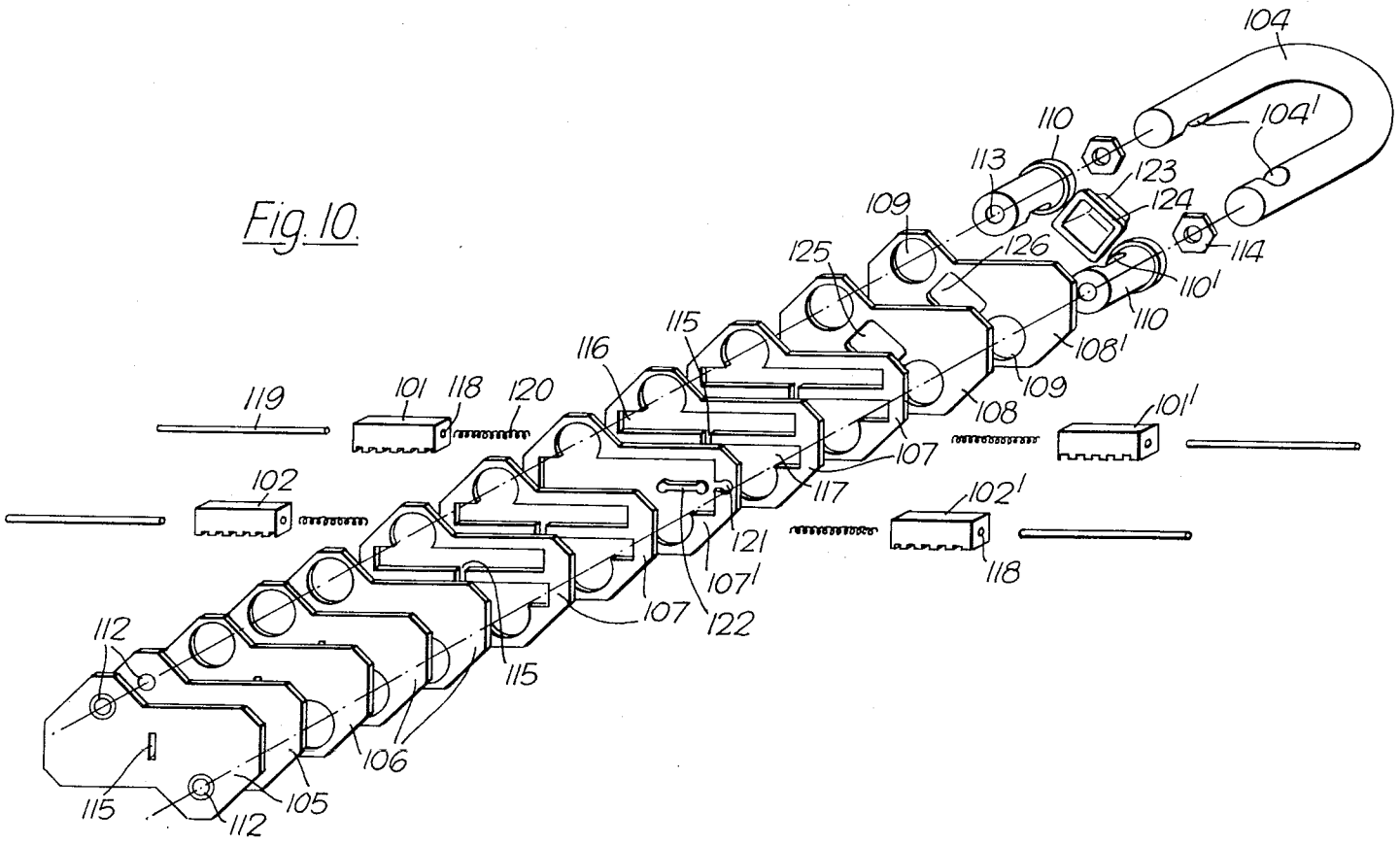

FIG. 10 is an exploded axonometric view showing most of the parts of the padlock according to FIGS. 7–9.

Figure 11:
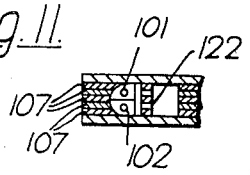

FIG. 11 is a partial detail thereof in cross-section.

Figure 12:
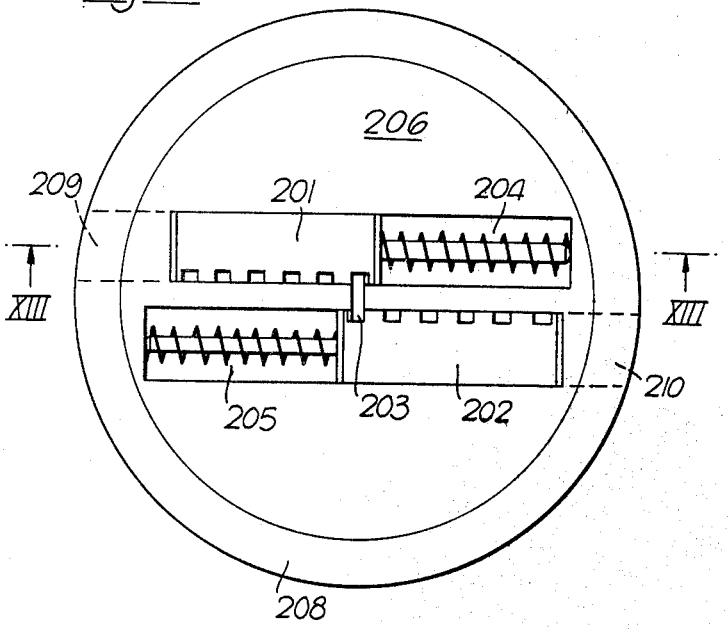

FIG. 12 is a plan view of a further embodiment of the locking mechanism according to the invention incorporated in a rotatable disk.

Figure 1:
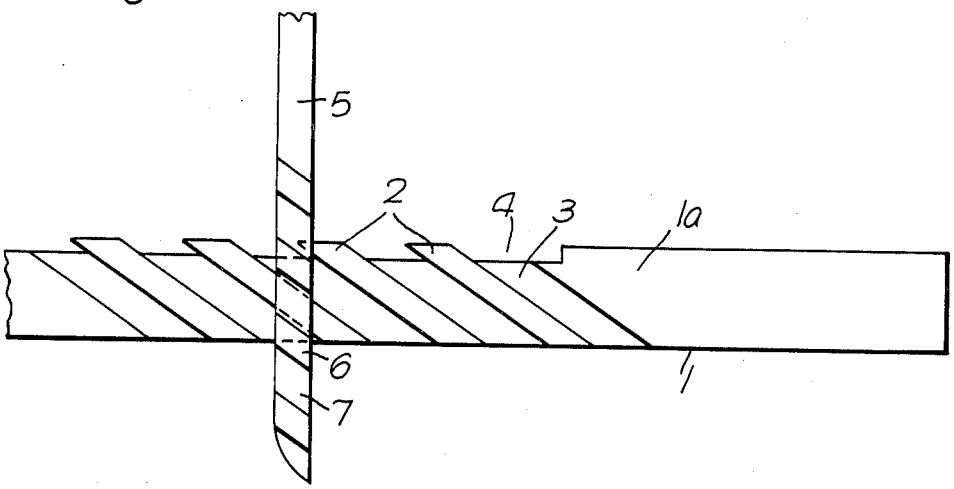
FIG. 1 is a partial side elevation of one embodiment of a locking mechanism according to the invention.
Figure 13:
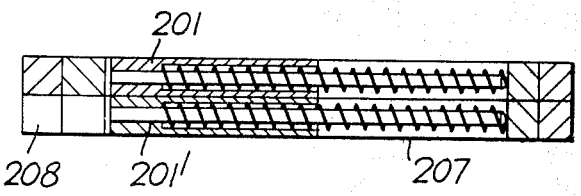

FIG. 13 is a section thereof on line XIII—XIII of FIG. 1.

Figure 14A:
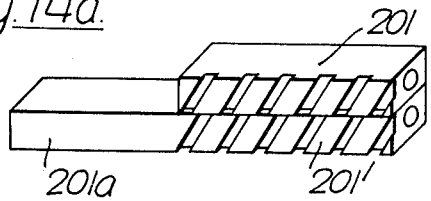
Figure 14B:
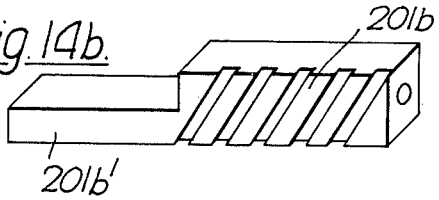
Figure 14C:
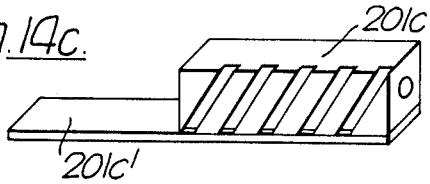

FIGS. 14*a*–14*c* are perspective views of three different embodiments of locking bolts.

Figure 15:
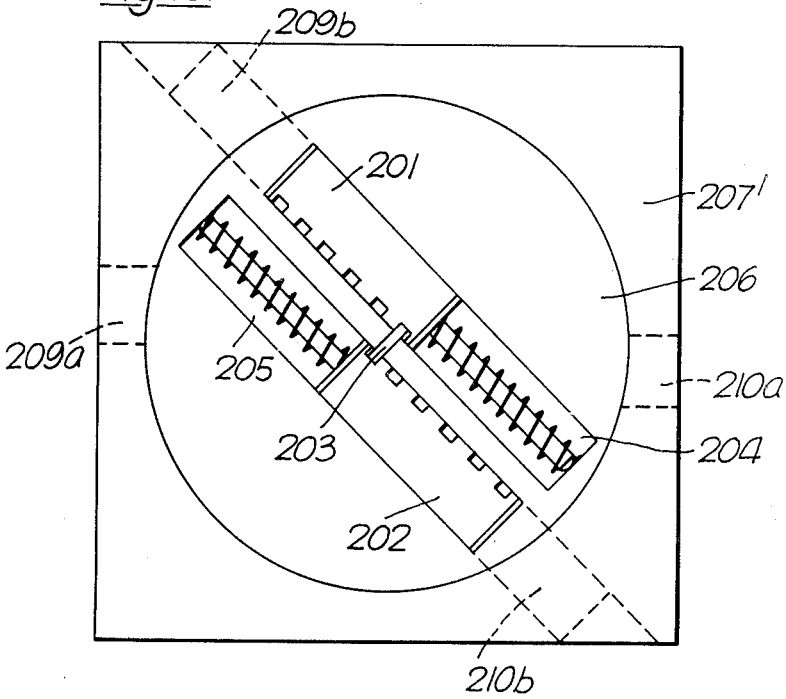

FIG. 15 is a plan view of a still further embodiment of the invention.

Figure 16:
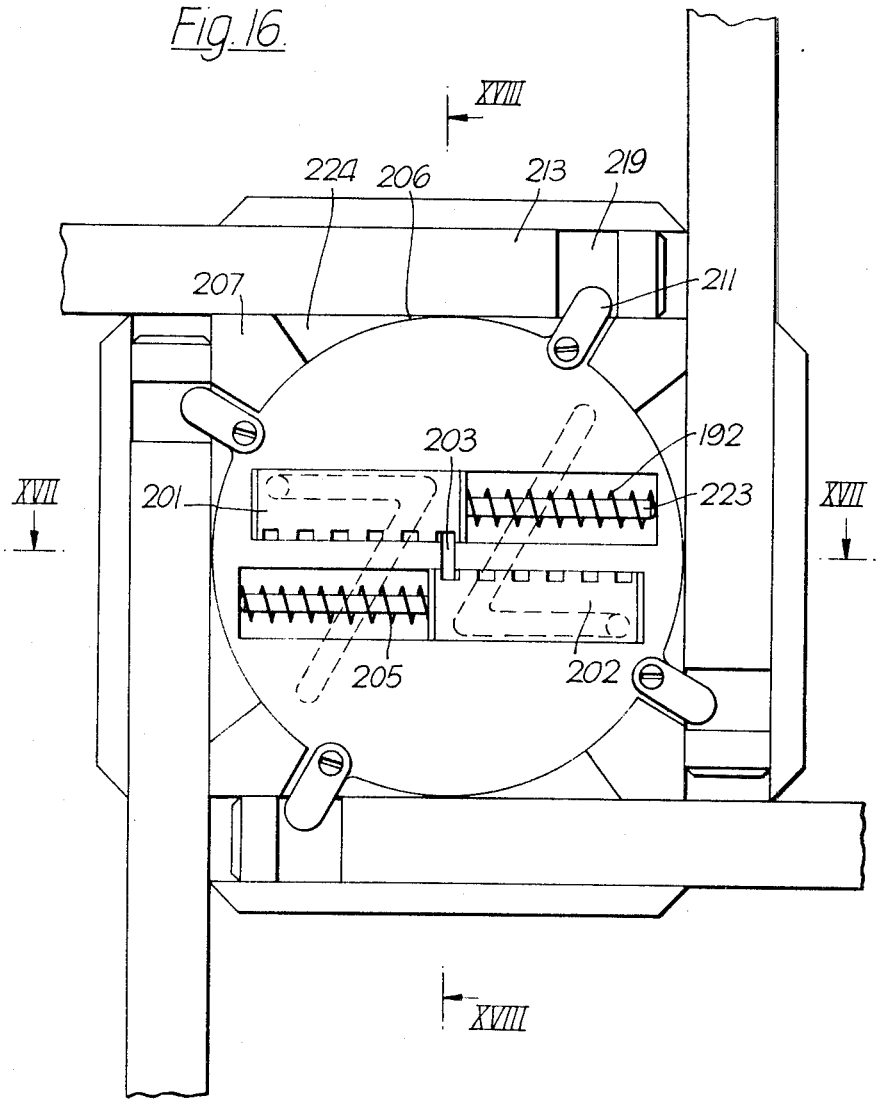

FIG. 16 is a plan view of a lock incorporating the locking mechanism according to the invention.

Figure 17:
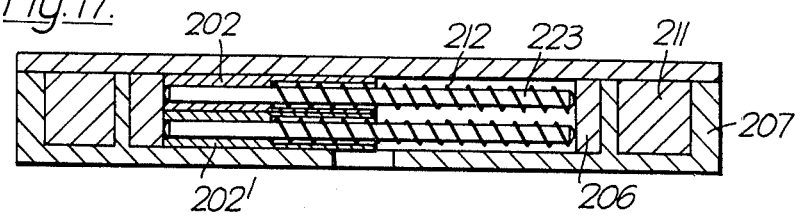

FIG. 17 is a section thereof on line XVII—XVII of FIG. 16.

Figure 18:
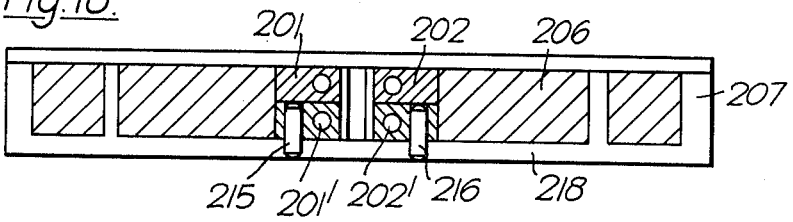

FIG. 18 is a partial section thereof on line XVIII—XVIII of FIG. 16.

Figure 19:
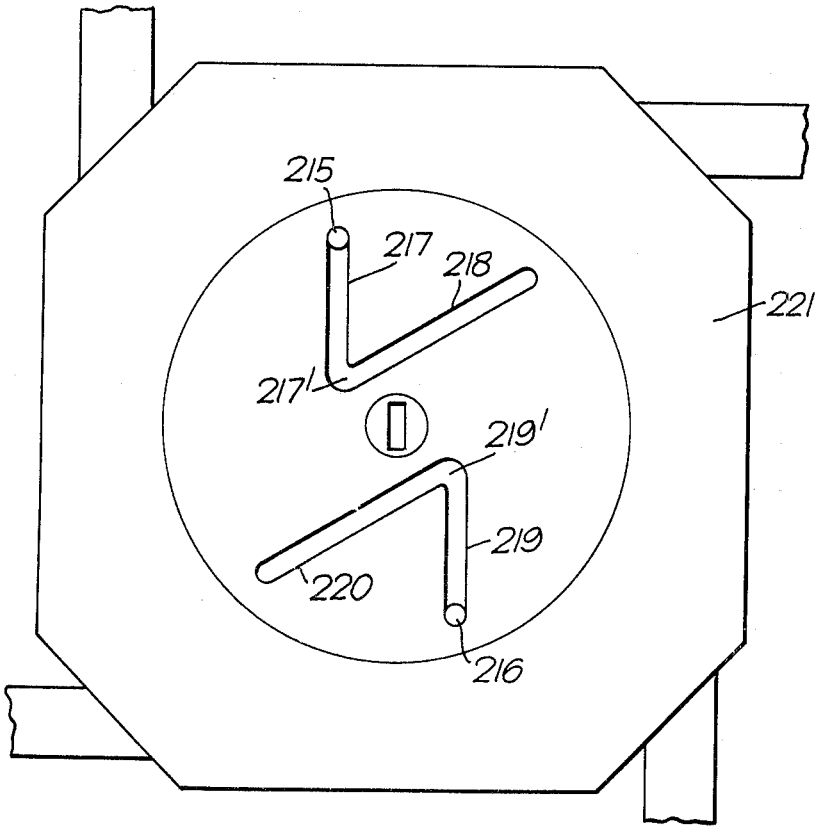

FIG. 19 is a partial rear view of the lock of FIG. 16.

Figure 20:
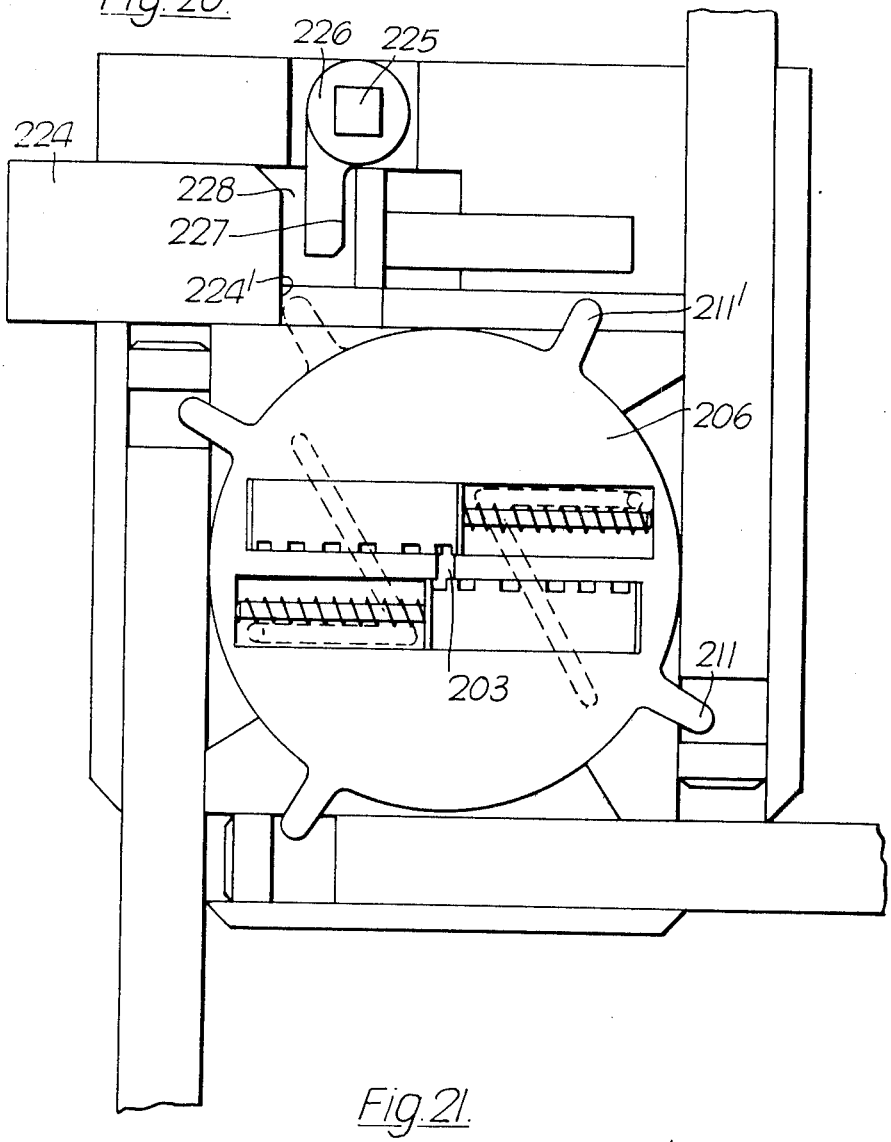

FIG. 20 is a plan view of a variation of the lock according to FIGS. 16–19.

Figure 21:
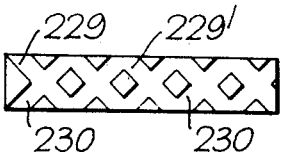

FIG. 21 is a partial detail of a key adapted to be used with the lock according to the invention.

According to the invention and as illustrated in FIG. 1 a bolt 1 is provided at its side edge with a plurality of spaced parallel teeth 2 at a substantially 45° angle, the teeth having spaces 3 between them. The top surface 4 of the bolt in the region of the teeth 2 is somewhat lowered so that the teeth project above said surface 4, and are flush with the part 1a of the bolt which is without teeth, as described hereinafter. This bolt is destined to be used in a latch lock.

A flat key 5 is provided with teeth 6 and spaces 7 between them on its side edge, likewise substantially at a 45° angle. The width of teeth 6 matches the spaces 3 of bolt 1, while the width of spaces 7 matches the width of teeth 2, so that, as can be seen in FIG. 1, as key 5 is pushed or pulled, as the case may be, in a direction perpendicular to bolt 1, the latter is moved linearly.

The lock shown and described in FIGS. 2–5 is provided with two bolts 1 and 1' guided for longitudinal movement in a housing 8 and being adapted to be shot and to project therefrom at 9. The operating mechanism of bolt 1 only will be described hereinafter, it being understood that the operating mechanism for bolt 1' is the same, but in mirror symmetry to that of bolt 1.

The locking movement of bolt 1 is effected with the aid of a spring 10 provided in a channel 11 in the housing, one end of the spring 10 abutting against the housing while the other abuts against a pin 12 extending from the side of the bolt into the channel 11.

Bolt 1 is provided with a throughgoing longitudinal slot 13 into which extends a pin 14 mounted on a plate-like carriage 15 which is adapted to be moved in a space 17 provided in the housing by means of a handle 16, provided on the outside of the housing. The handle 16 extends through to the inside of the housing 1, its neck 16' being adapted to be moved in a slot 17' therein. A key-hole 18 is provided on the inside of the housing, a similar aligned key-hole 19 surrounded by a guide 20 being provided at the outside of the housing, i.e. preferably integral with a cover 21.

A mechanism for preventing the movement of the bolts in the extended position without the use of the key or the handle 16 is provided according to the invention. This mechanism comprises a lever 22 pivotal on pin 23 and having an arm 24 at its free end, which extends in register with key-hole 18, the free end being turned slightly upwardly at 25. Lever 22 is urged by means of spring 26 held on pin 27 in housing 8 towards key-hole 18 and thus into the path of the upwardly projecting teeth 2. Lever 22 is provided with two abutment faces 28 and 29 for pin 14 in the two extreme positions of handle 16 as will hereinafter be explained.

Figure 2:
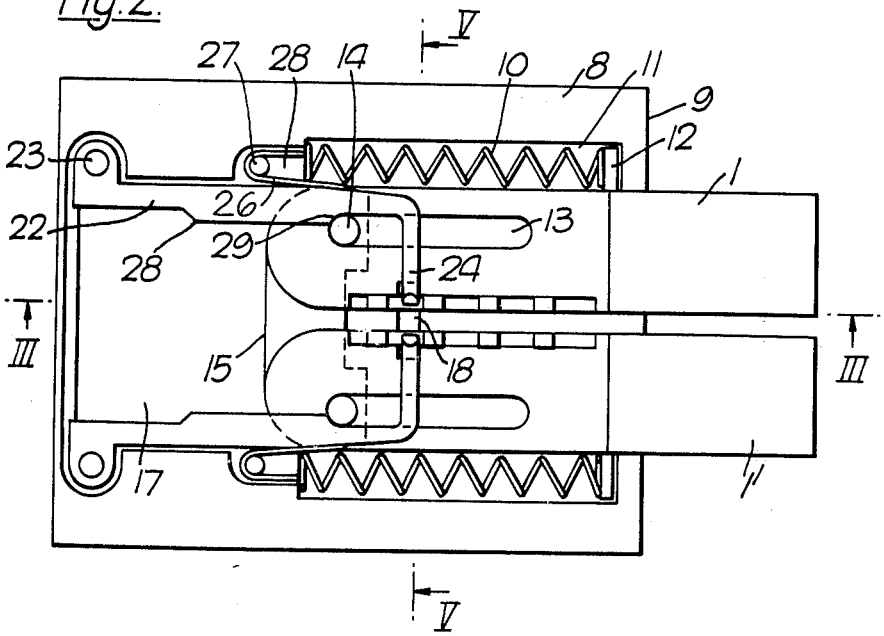
FIG. 2 is a plan view of a latch lock incorporating said mechanism in the extended locking position of the bolts, the cover being removed.
Figure 3:
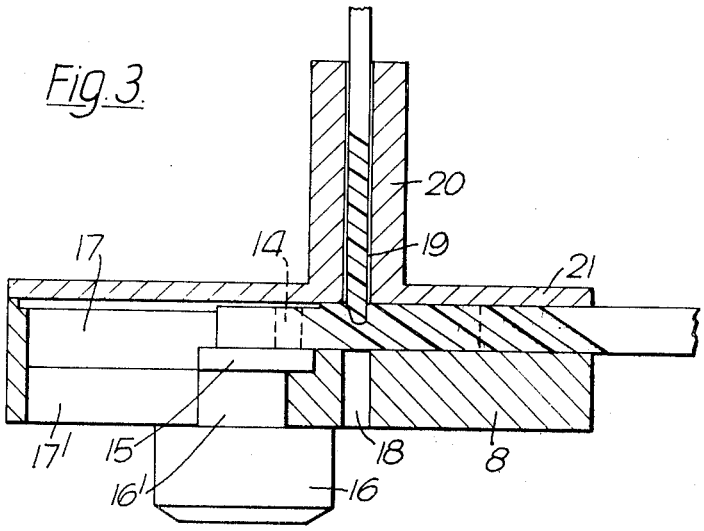
FIG. 3 is a longitudinal section thereof, taken on line III—III of FIG. 2, parts being removed for the sake of clarity.
Figure 5:
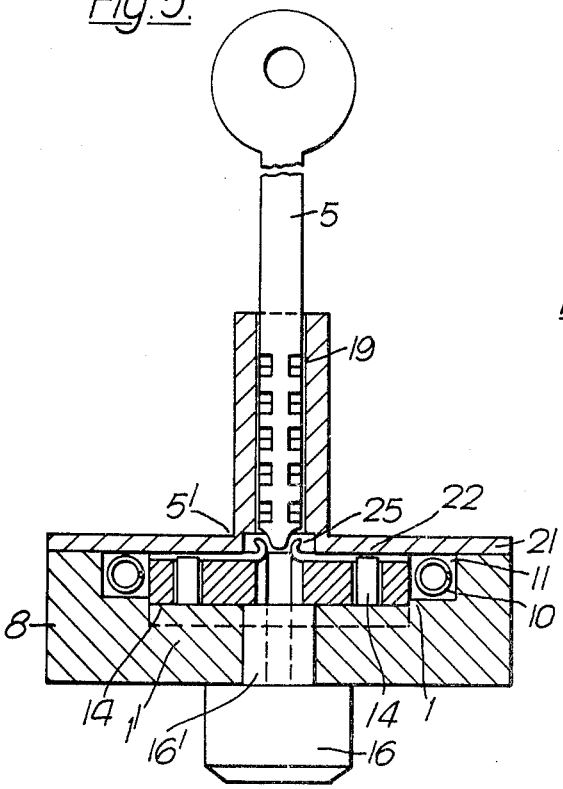
FIG. 5 is a cross section of the lock taken on line V—V of FIG. 2.

The lock works as follows:

As shown in FIGS. 2 and 5, which show the lock in working (locking) position, when key 5 is inserted into key-hole 19 the pointed bottom 5' of the key is inserted between lever ends 25 pushing them aside against the action of spring 26, so that the key can be fully inserted and the bolts 1 and 1' can be withdrawn. In the position shown in FIGS. 2 and 3 only the key or the handle 16 when operated causes the retraction of bolt 1, 1'. The movement of handle 16 in slot 17' causes pin 14 to push the levers 22 outward against action of spring 26.

Figure 4:
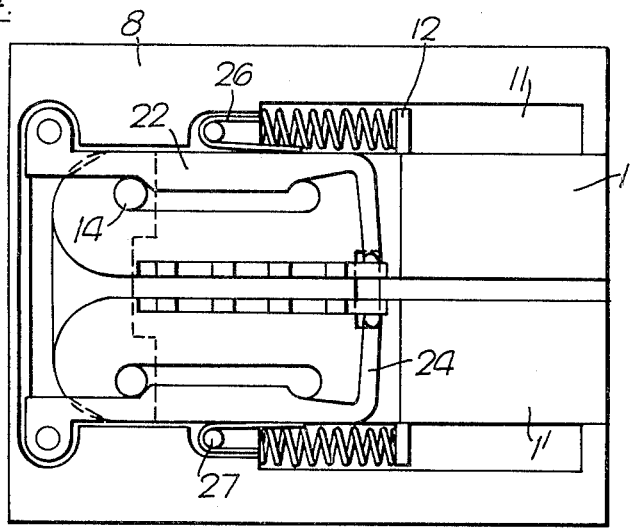
FIG. 4 is a view similar to that of FIG. 2 in the unlocking position of the bolts.

The door can now be opened and in this open position when the key is removed the bolts 1, 1' will again be extended by the action of the springs 10. In order to close the door, handle 16 has to be operated from within, whereby pins 14 will be moved from abutment face 29 to abutment face 28 of lever 22 as is shown in FIG. 4.

From the inside, bolts 1, 1' may be extended, either by the operation of handle 16 or by the insertion of key 5 into key-hole 18. From the outside, however, as can be seen, only key 5 can withdraw the bolts.

The teeth 2 and 7 may have any suitable matching shape. Adjacent teeth may be of equal pitch, or the pitch between adjacent teeth may vary along the row of teeth, the teeth 7 of the key matching the spaces 3 of the bolt. Furthermore, it is within the scope of the present invention to provide teeth with different pitch characteristics on bolts 1 and bolts 1', it being understood that the key 5 will have to be provided with teeth on either side, which match the spaces of the corresponding bolt, the teeth on either side of the key not being aligned relative to each other in this case.

It is further within the scope of the present invention to provide teeth 2 at an angle other than 45', i.e. from 10°-80°, the teeth on key 5 being at a complimentary angle, if it is desired that the key move perpendicular to the lock. Otherwise, the teeth 7 on key 5 may be inclined at any suitable angle, the key being held at a corresponding angle to the face of housing 8. Furthermore, the height of the teeth and the depth of the spaces between them may vary from tooth to tooth.

In the locking mechanism shown in FIGS. 6*a* and 6*b*, the bolt is constituted by two pairs of superposed bolt parts, the parts 101 and 102 of each pair being identical with each other. In the starting position, i.e. the unlocking position wherein the two parts are exactly superposed, the teeth are not aligned. In order to bring the parts into locking position the key (not shown) is inserted into the lock and first moves part 101 relative to part 102 until their teeth are aligned with each other, so that both parts can be moved together linearly, as shown in FIG. 6*b*. In this manner, when a burglar tries to pick the lock, by means of any type of wire or blade, the chances of moving first one bolt part and aligning its teeth to those of the other part are minimal. It is, of course, understood that each bolt can be made of more than two superposed parts, if so desired.

The padlock illustrated in FIGS. 7-11 incorporates two parallel bolt pairs, each made of two parts as described in FIGS. 6*a*, 6*b*. This padlock comprises a base generally indicated by 103 and a shackle or bow 104 having cut-away portions 104' near each end, which, when engaged by the bolts, are locked tightly in the base. The base 103 may be made in any suitable manner of any suitable number of parts, e.g. it may be cast and milled, if desired. For the sake of ease of manufacture, as described hereinafter, the base is made of twelve superposed plates which may be stamped from sheet metal. As shown in FIG. 10 there are two plates 105, three plates 106, four plates 107, one plate 107', one plate 108 and one plate 108', the plates all having the same profile in plan and those with the same reference numeral being identical to each other. All base plates except plates 105 are provided with a pair of holes 109 adapted to house flanged bushings 110 into which the ends of shackle 104 extend, the bushings 110 having cut-outs 110' aligned with cut-away portions 104' of shackle 104. The bushings are held within holes 109 by means of screws 111, which extend through holes 112 in plates 105 and through a hole 113 in bushing 110, nuts 114 inserted within the bushing 110 being screwed onto the screws 111 for a tight connection of all the plates. In all the plates except in plates 108, 108', a central slot 115 is provided, the slots 115 of all the plates being in vertical register and being destined to receive the flat key (not shown).

Plates 107 and 107' together are of a thickness equal to the thickness of bolt parts 101, 102 and are provided with two parallel cut-outs 116, 117, which constitute the guides for the bolt parts 101, 102 and 101', 102', respectively, the slot 115 merging on either side into said cut-outs. Each bolt part is provided with a through-going axially extending bore 118 for housing a guide bar 119 on which a coil spring 120 is threaded, the springs 120 urging the bolt parts into locking position. The thickness of plates 107, 107' and bolt parts 101 and 102 are such that the bolt parts meet in the median plane of plate 107'. In this plate 107' the cut-outs 116, 117 merge into each other. In their longitudinal center line two circular cut-outs 121 are provided merging into them and each housing one circular end of a locking catch 122. These catches are provided as a further safety means against the picking of the lock. As can be most clearly seen from FIGS. 10, 11 the catches are slightly pivotal within cut-outs 121, i.e. within plate 107'. In either the locked or unlocked position of the bolt parts, each catch 122 is urged sideways by the bolt parts of one side of the lock into the space behind the parallel bolt parts of the other side of the lock, thereby preventing movement of the individual bolts unless they are all moved simultaneously. During movement by the proper key, the catches are pivotted to the oppositely lying space which is being cleared by the moving bolt part. Since the catches are located in plate 107' they extend somewhat above and below into the area of both bolt pairs. Only if a burglar would succeed to move all four bolt parts simultaneously, a feat which without a proper key is practically impossible, could he prevent the catches 122 from interfering with the movement of the bolt parts. However, even if he succeeds by the insertion of a wire or other means into the slots 115 to move one or the other bolt part the catches will interfere with the movement of the remainder of the bolt parts, making the picking of the lock impossible.

As has been described before, the bolts are moved linearly into locking or unlocking position by the key (not shown) moving through slots 115 at right angles to the plates 105-108. In order to close the slots on the top side of base 103 a cap 123 is provided which has flange 124 adapted to be housed in a cut-out 125 of plate 108, the top of the cap 123 extending through a cut-out 126 in plate 108', which cut-out is smaller than cut-out 125, it being understood that cap 123 is inserted into the plates 108, 108', when the base is being assembled.

It is, of course, understood that only one set of superposed bolts may be provided to engage only the end of one leg of the shackle, the other leg of the shackle being adapted to be partially drawn from the base and to be rotated relative thereto in order to open the lock, as is known in many padlock constructions.

The lock shown in FIGS. 12 and 13 comprises two pairs of locking bolts 201, 201', 202, 202', which are housed and guided in cut-outs 204, 205 respectively within a circular disc 206, which is supported and rotatable on a plate support 207, having a peripheral flange 208 surrounding said disc. An aperture 203 is provided for the insertion of a key having matching teeth.

Both bolts are of the construction shown in FIGS. 14*a*–14*c* only one bolt being shown therein. In FIG. 14*a* bolt 201' is longer than bolt 201, the latter having an integral smooth extension 201*a*, i.e. without teeth. In FIG. 14*b* the bolt 201*b* is made only of one part, the integral extension 201*b'* being smooth and substantially half the height of the part 201*b* provided with teeth. In FIG. 14*c* a thin plate 201*c'* is attached to the bottom of toothed bolt 201*c*, plate 201*c'* being narrower but longer than bolt 201*c*.

The cut-outs 204, 205 in disc 206 are extended to the circumference at one end and slots 209, 210 respectively are made in flange 208, the slots corresponding in shape to the extension of bolt part 201*a'*, 201*b'* or 201*c'*, as the case may be.

In the position shown in FIGS. 12 and 13, the rotation of disc 206 in support 207 is prevented by said bolt parts extending into slots 209, 210 when a key is inserted into aperture 203. The bolts are again moved linearly whereby said bolt parts are withdrawn from the corresponding slots so that disc 206 can be rotated.

In FIG. 15, wherein parts similar to those of FIGS. 12–14 are designated by the same reference numerals, the rotation of disc 206 can be locked in two different positions. The support plate 207 is herein replaced by a plate 207' having a depression in which disc 206 is rotatable. In addition to slots 209*a*, 210*a*, slots 209*b*, 210*b* are provided in plate 207' at an angular distance from slots 209*a*, 210*a*, respectively. Thus, when a key is inserted to withdraw bolts 201, 202 from slots 209*a*, 210*a*, the disc 206 can be rotated when it reaches an angular position where cut-outs 204, 205 are aligned with slots 209*b*, 210*b* and the key is removed, the bolt extension will enter the latter to again lock the rotary movement of the disc 206.

It must be understood, that while in the description of the FIGS. 12–15, two bolts or bolt pairs are shown, the locking mechanism may be provided with one bolt or bolt pair only.

The application of the invention to a door lock is illustrated in FIGS. 16–21, the parts which are the same as those of FIGS. 12–15, being designated by the same reference numerals and thus do not require further description. The disc 206 is here housed and is rotatable within a depression in a plate support 207*a* being of substantial square shape and having mitered corners. Said disc is provided at its top with four outwardly extending lugs 211 adapted to engage apertures 212 of four locking bars 213. Each of said bars is adapted to slide linearly and is guided in a groove at one side of housing 207*a*, each locking bar being destined to engage a side of the door (not shown) when said lock is mounted within a door.

To locking bolts 201', 202' respectively, pins 215, 216 are mounted, said pins being adapted to engage in slots 217, 218, 219, 220 respectively, provided in the bottom 221 of housing 207. The areas of merger 217', 219' of stretches 217, 218 and 219, 220, respectively, are enlarged for a purpose which will become clear hereinafter.

In the position shown in FIG. 16 the locking bolts 201, 201', 202, 202' are in a position of rest, i.e. the bars 213 are withdrawn from their locking position. If a key is inserted in opening 203, bolts 201, 201', 202, 202' are moved linearly thereby whereby pins 215, 216 are moved within slot stretches 217, 219 respectively, until they reach the areas of merger 217', 219' of the slot stretches. Since at these areas there is a certain freedom of movement for the pins, the key can rotate disc 206 in this position, whereby simultaneously lugs 211 force bars 213 into extended position, and springs 222, mounted on rods 223, of the locking bolts, as described above with reference to FIGS. 6–11 force locking bolts 201, 201', 202, 202' into slot stretches 218, 220 respectively. The key can be withdrawn and the lock is now in locking position. The top parts of housing 207 are cut away at 224 to permit lugs 211 to move freely from one position to the other, the extremities of said portions providing safety stops for the rotational movement. A rotation by the key in opposite direction until pins 215, 216 reach the inner ends of slot stretches 218, 220 respectively, will cause the unlocking of the lock, whereafter said springs force said pins into the starting position shown in FIG. 16.

As shown in said figures a 45° turning of disc 206 effects the locking or unlocking owing to the shape of slots 217, 218, 219, 220 and merger areas 217', 219'. It is, of course, understood that any other shape of slot, i.e. other than its stretches lying at 45° to each other may be provided whereby the disc can be rotated more than 45°. Instead of lugs 211, the disc 206 may be provided with peripheral gear teeth and bars 213 with matching teeth. Furthermore, links, cams or any other means may be provided to transmit the rotational movement of the disc to a linear movement of the bars.

The bolts may be of any other profile, i.e. round, semi-circular, triangular or the like, than the rectangular profile shown in the drawing, guiding grooves of corresponding suitable shape being provided within disc 206.

It is possible also to provide guiding grooves for the bolts within an insert of any suitably shaped body which may be mounted within disc 206.

In the embodiment of the lock shown in FIG. 20 one of the bars 213 is replaced by the ordinary latch bolt 224 associated with a known door lock, the supporting plate or housing 207*b* being extended for this purpose. This latch bolt, besides being adapted to be moved by a lug 211' of disc 206 which engages an abutment 224' in said bolt 224 is adapted to be moved independently by means of a handle (not shown) mounted on a square shaft 225 in a lug 226 whose nose 227 engages within a cut-out 228 made in latch bolt 224. It can be seen that a rotation of lug 226 effects the linear movement of latch bolt 221 independently of the locking movement of disc 206.

FIG. 21 shows schematically part of the side edge of a key in which teeth 229, 229' are made in one direction and teeth 230, 230' in the other direction. These teeth match the teeth of bolts 201, 201', 202, 202' so that the said key when inserted from either side of the lock into hole 203 actuates said bolts.

While in the FIGS. 16–20 and the corresponding description a lock having two pairs of parallel locking bolts has been described, it is within the scope of the present invention, to provide a lock with only one bolt or one pair of superposed bolts of the kind described, in one half of the disc and only one slot for the pin of said bolt in the housing.

We claim:

1. A locking mechanism having at least one locking bolt supported for guided linear movement in a housing between locked and unlocked positions, said mechanism being characterized in that said locking bolt is comprised by at least two superposed bolt parts which are linearly movable along the longitudinal axis of the bolt relative to each other and are provided on the corresponding longitudinal edges thereof with a plurality of spaced matching teeth at an angle of 10°–80°, a key adapted for guided linear movement through a key-hole perpendicular to said bolt parts and having teeth matching those in the bolt parts formed in at least one of its side edges at a matching angle, the movement of the bolt parts being effected by the meshing of their teeth with those of the key upon insertion of the key in a manner such that one of the bolt parts moves linearly along the longitudinal axis of the bolt with continued insertion of the key until its teeth become aligned with the teeth in the other bolt part at which point both bolt parts move together as a single locking bolt between locking and unlocking positions.

2. A locking mechanism as set forth in claim 1 wherein there are two locking bolts with each locking bolt moving in a direction opposite to the other and said key has respective matching teeth for the respective bolt parts of each bolt formed on the opposite side edges thereof.

3. A locking mechanism as claimed in claim 1 wherein all the teeth are of the same pitch and have any suitable profile such as rectangular.

4. A locking mechanism as claimed in claim 1 wherein each such bolt part is engaged by a spring which urges it into locking position.

5. A locking mechanism as claimed in claim 2 wherein the oppositely moving bolts lie parallel to each other with the confronting edges thereof which face each other being provided with said teeth and the key is provided at its respective side edges with teeth which match the teeth of the respective bolts.

6. A locking mechanism as claimed in claim 5 wherein the teeth formed in one side edge of the key are different from the teeth formed in the other side edge and the coacting sets of teeth in the two oppositely moving bolts are correspondingly different so that they mate with only a respective set of teeth on one of the side edges of the key.

7. A padlock comprising a housing for the locking mechanism as claimed in claim 1 and a shackle and wherein the superposed parts of the bolt are adapted to engage a cut-out near the end of at least one of the legs of the shackle while in the locking position.

8. A padlock as claimed in claim 7 wherein the housing of the padlock is made of superposed stamped plates which are held together by bushings and screws, the bushings having cut-outs in register with said cut-outs of the shackle.

9. A padlock as claimed in claim 8 wherein at least one additional pivotal locking catch is provided within a cut-out in at least one of the stamped plates adjacent the bolt parts with said catch extending sideways into free space between the bolt parts and the housing in either the locked or unlocked position of the bolt parts.

10. A locking mechanism as claimed in claim 2 wherein all the teeth are of the same pitch and have any suitable profile such as rectangular.

11. A locking mechanism as claimed in claim 2 wherein each such bolt part is engaged by a spring which urges it into locking position.

12. A locking mechanism as claimed in claim 1 wherein said locking bolt is lodged within a disc and is adapted to be moved linearly therein by a key having matching teeth, said disc being lodged in a support and being adapted to be rotated thereon, means being associated with said bolt to prevent said rotation.

13. A locking mechanism as claimed in claim 12, wherein said support is provided with a flange surrounding said disc, at least one cut-out being provided in said flange, said bolt being provided with an extension without teeth which is adapted to engage in said cut-out to prevent said rotation.

14. A locking mechanism as claimed in claim 12, wherein said bolt is provided with a pin or lug extending into a slot in said support, said slot having a stretch aligned with said bolt and a stretch merging therewith, which corresponds in shape and length to the extent of rotary movement of the disc desired.

15. A locking mechanism as claimed in claim 14, wherein said merging stretch is of arcuate shape.

16. A locking mechanism as claimed in claim 14, wherein said merging stretch is linear at an angle to said first mentioned stretch, the area of merger being enlarged.

17. A latch lock comprising the locking mechanism of claim 2 wherein at least one of said bolts is integral with an extension having no teeth, said extension constituting the latch of the lock.

18. A lock incorporating the locking mechanism claimed in claim 22 wherein said disc is rotatably housed in a plate support and is provided with means adapted to move linearly at least one locking bolt, a pin being fixed on said locking bolt and being adapted to be moved in a slot in the plate when said bolt is moved by said key, said slot having such a contour that when the pin is in the two end positions of the slot, the disc can be rotated to move said locking bars.

19. A lock as claimed in claim 12, wherein two parallel locking bolts are provided on either side of the diameter of the disc, each bolt carrying a pin adapted to be moved within a slot.

20. A lock as claimed in claim 12, wherein one of the locking bars is constituted by the known latch bolt of door locks operable independently by the door handle or by said means on said disc.

21. A lock as claimed in claim 20, wherein said means on said disc are outwardly extending lugs each adapted to engage an aperture in said locking bars.

22. A lock as claimed in claim 20, wherein said means on said disc are constituted by peripheral teeth adapted to engage matching teeth on said locking bars.

* * * * *